United States Patent [19]

Menser

[11] 4,263,677

[45] Apr. 28, 1981

[54] METHOD AND MEANS FOR FINISHING THE JOINTS BETWEEN PLASTERBOARD WALL PANELS

[75] Inventor: Howard K. Menser, Plymouth, Ind.

[73] Assignee: Menser Industries, Plymouth, Ind.

[21] Appl. No.: 75,812

[22] Filed: Sep. 14, 1979

[51] Int. Cl.[3] ..... A41D 19/00; E04F 21/165

[52] U.S. Cl. ..... 2/158; 15/244 C; 15/235.3; 52/741; 2/161 R

[58] Field of Search ..... 2/158, 161 R, 167, 168; 15/227, 244 C, 235.3; 52/741

[56] References Cited

U.S. PATENT DOCUMENTS

| | | | |
|---|---|---|---|
| 2,269,721 | 1/1942 | Johnson | 15/244 C |
| 2,790,982 | 5/1957 | Schneider | 15/227 X |
| 2,942,285 | 6/1960 | Gray | 15/244 C X |
| 3,608,708 | 9/1971 | Storandt | 2/158 X |
| 3,878,581 | 4/1975 | Perna | 15/235.3 X |

*Primary Examiner*—Peter P. Nerbun

*Attorney, Agent, or Firm*—Oltsch, Knoblock & Hall

[57] ABSTRACT

A sponge mitt is covered with an abrasive surface material. The mitt is composed of a sponge material covered with a piece of woven, knitted or mesh material. The mitt is used wet to treat and smooth a joint between plasterboard drywall building panels.

5 Claims, 2 Drawing Figures

METHOD AND MEANS FOR FINISHING THE JOINTS BETWEEN PLASTERBOARD WALL PANELS

SUMMARY OF THE INVENTION

This invention relates to a method and means for finishing the joints between plasterboard wall panels.

Previously, the finishing of joints between drywall or plasterboard wall panels during construction or remodeling of a building was a messy and irritating process. First tapes were adhered at the marginal surfaces of adjacent panels and were sanded when dry and then were washed to re-seal the plaster. This required that the dust that was produced during sanding had to be cleaned away and removed. During the sanding operation, the sander, and those in his immediate vicinity, were required to take precautions not to breathe the dust in the air since the breathing of such dust could lead to lung infirmities and disorders.

The present invention offers a solution to these problems by making the finishing of joints between plasterboard panels a one step operation. A water absorbent mitt is worn on the hand of the user and immersed in water to wet it. The wet mitt is then rubbed over the surface of the joints between the drywall panels. An abrasive mesh material covers the mitt and when rubbed against a panel joint smooths the surface of the drywall joint. The wet sponge wets, absorbs and collects the abraded plaster particles. The use of the wetted mitt also serves to supply moisture to the joint spanning tape and to reseal the tape at the marginal surface of adjacent panels. Cleaning of the mitt is achieved by simply rinsing the mitt in water.

Accordingly, it is an object of this invention to provide means of facilitating the smoothing of joints between drywall or plasterboard panels.

Another object is to provide a single step method for finishing joints between drywall panels.

Another object is to provide a method to increase the safety of workmen during finishing of joints between panels.

Other objects will become obvious upon reading the following description.

DESCRIPTION OF THE PREFERRED EMBODIMENT

Figure 1:
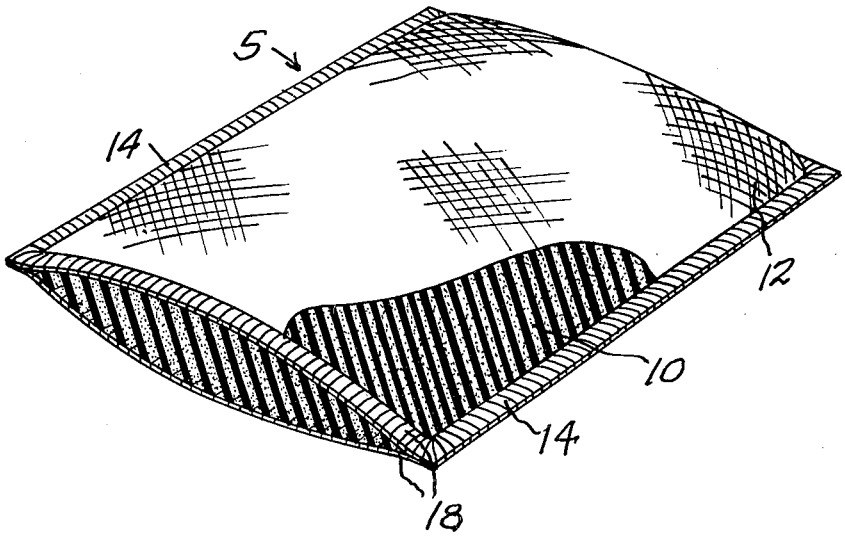
FIG. 1 is a perspective view of the mitt with a part broken away.
Figure 2:
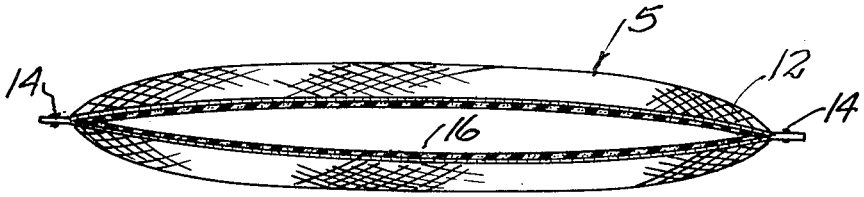
FIG. 2 is a cross sectional view of the mitt taken on line 2—2 of FIG. 1.

The preferred embodiment illustrated is not intended to be exhaustive or to limit the invention to the precise form disclosed. It is chosen and described in order to best explain the principles of the invention and its application and practical use and to thereby enable others skilled in the art to best utilize the invention.

Referring to the drawings, mitt 5 is formed of sheets of foam or sponge material 10 of an open cell type which is covered at its outer surface with a mesh material 12. The sponge 10 may be formed of a single sheet folded to a predetermined shape, rectangular in this embodiment, and marginally stitched at 14 at three edges. The mesh material 12 is sewn to the foam by stitching 14, preferably with nylon thread. The mesh material is also stitched at 18 at the open side of the mitt to prevent separation of the mesh 12 from the sponge 10. Mitt 5, being sewn at 14 along only three edges 14 provides an opening 16 for the insertion of the user's hand. For best results, mesh 12 is preferably produced from nylon or polyester fibers and the thread for stitching at 14 and 18 is preferably produced of nylon to insure longevity of use.

To use the mitts, the user applies it to his hand and immerses it in water or other liquid. It is then rubbed against the tape covered joints between drywall panels. The mesh 12 abrades the surface of the drywall and the moisture expelled from the sponge 10 incident to the rubbing action absorbs abraded dust particles and wets the joint surfaces to reseal the tape and smoothened plaster. To remove dust from the mitt 5, it is immersed into the water and rinsed, thereby preparing the mitt for further use.

It is understood that the invention is not to be limited to the preceding description but may be amended within the scope of the appended claims.

What I claim is:

1. A mitt for finishing joints between drywall panels comprising, in combination, an open cell sponge panel, an opposed panel, and an outer abrasive mesh material covering the outer surface of each sponge panel, said mesh material being secured to each sponge panel along all edges thereof and being sewn at three edges thereof to said opposed panel whereby said mitt has an opening at one edge to facilitate insertion of a user's hand therethrough.

2. The mitt of claim 1, wherein said abrasive mesh material is woven and composed of a member of a group including nylon and polyesters.

3. The mitt of claim 1, wherein said sponge panel is a flexible material of the class consisting essentially of natural sponge, latex foam and urethane foam.

4. The mitt of claim 1, wherein said panels are formed of a sheet of foam material folded upon itself and sewn together at three margins thereof.

5. The method of finishing joints between plasterboard wall panels defined by tapes adhered to marginal portions of adjacent panels, consisting of the step of rubbing said joints with an open cell sponge panel covered with an abrading mesh material while said sponge panel contains an absorbed liquid so as to wash and smooth said joints and absorb and collect particles abraded by the mesh.

* * * * *